US011808450B2

(12) United States Patent
Waldner et al.

(10) Patent No.: US 11,808,450 B2
(45) Date of Patent: Nov. 7, 2023

(54) GRATE BLOCK WITH RISING NOSE

(71) Applicant: HITACHI ZOSEN INOVA AG, Zürich (CH)

(72) Inventors: Maurice Henri Waldner, Wettingen (CH); Werner Brennwald, Neftenbach (CH)

(73) Assignee: HITACHI ZOSEN INOVA AG, Zurich (CH)

( * ) Notice: Subject to any disclaimer, the term of this patent is extended or adjusted under 35 U.S.C. 154(b) by 0 days.

(21) Appl. No.: 18/025,414

(22) PCT Filed: Sep. 9, 2021

(86) PCT No.: PCT/EP2021/074785
§ 371 (c)(1),
(2) Date: Mar. 9, 2023

(87) PCT Pub. No.: WO2022/053551
PCT Pub. Date: Mar. 17, 2022

(65) Prior Publication Data

US 2023/0258333 A1 Aug. 17, 2023

(30) Foreign Application Priority Data

Sep. 9, 2020 (EP) ..... 20195290

(51) Int. Cl.
*F23G 5/00* (2006.01)

(52) U.S. Cl.
CPC ..... *F23G 5/002* (2013.01); *F23G 2203/101* (2013.01); *F23G 2203/803* (2013.01)

(58) Field of Classification Search
None
See application file for complete search history.

(56) References Cited

U.S. PATENT DOCUMENTS 4,078,883 A 3/1978 Arnold
4,515,560 A 5/1985 Jacquemin et al.
(Continued)

FOREIGN PATENT DOCUMENTS

DE 568 164 C 1/1933
DE 969 643 C 6/1958
(Continued)

OTHER PUBLICATIONS

Dec. 22, 2021 International Search Report issued in International Patent Application No. PCT/EP2021/074785.
(Continued)

*Primary Examiner* — Jason Lau
(74) *Attorney, Agent, or Firm* — Oliff PLC

(57) ABSTRACT

A grate block including a block body formed as a cast part with a rear end and a front end that lies opposite the rear end in the conveying direction. The block body includes an upper wall which forms an outer rear bearing surface, running at least in part parallel to a longitudinal axis of the block body, for the waste that is to be treated, wherein the bearing surface defines a substantially horizontal plane. The block body further includes a raised nose arranged in the region of front end, which nose has an outer front bearing surface with a middle part that rises in the manner of a ramp in the conveying direction. The raised nose includes, following the outer front bearing surface, an apex and, after the apex in the conveying direction, a declining end portion with a discharge surface that drops away in a substantially arcuate manner.

14 Claims, 3 Drawing Sheets

(56) References Cited

U.S. PATENT DOCUMENTS

| | | | | |
|---|---|---|---|---|
| 4,671,190 | A * | 6/1987 | Moreau | F23H 7/08 110/328 |
| 4,719,900 | A * | 1/1988 | Martin | F23H 17/12 110/298 |
| 2013/0167762 | A1 | 7/2013 | Schmid | |

FOREIGN PATENT DOCUMENTS

| | | |
|---|---|---|
| DE | 1 301 421 B | 8/1969 |
| DE | 201 11 804 U1 | 9/2001 |
| EP | 1 321 711 A1 | 6/2003 |
| RU | 2 013 704 C1 | 5/1994 |

OTHER PUBLICATIONS

Dec. 22, 2021 Written Opinion issued in International Patent Application No. PCT/EP2021/074785.
Jul. 1, 25, 2023 Office Action issued in Russian Patent Application No. 2023101167.

* cited by examiner

GRATE BLOCK WITH RISING NOSE

The present invention relates generally to an incineration grate intended for use in a refuse incineration plant. Incineration grates for the large-scale incineration of waste have been known to those skilled in the art for a long time. They are usually constructed from a multiplicity of individual grate bars that are joined together to form a corresponding incineration grate. This structure allows easy replacement of individual grate bars in the event of damage to individual regions of the grate.

In such refuse incineration plants, the incineration material is normally conveyed from an inlet end of the incineration grate to its outlet end (i.e. in the direction of conveyance) and incinerated during this process. For the purpose of delivering combustion air, also called primary air, into the incineration material, the crate bars, or grates, are supplied with an air flow from a bottom side and have outlet openings through which the supplied combustion air can enter the incineration material. Such grates, or grate bars, are known, for example, from DE 20111804 U1.

A frequently used incineration grate is the so-called staircase grate. This comprises grate blocks arranged next to each other, each forming a row of grate blocks. The rows of grate blocks in this case are arranged on top of each other in a staircase-like manner, and in the case of so-called moving grates the front end of a first grate block, as viewed in the direction of advance (or direction of conveyance of the incineration material), rests on a bearing surface of a second grate block, which is arranged, offset in the direction of advance, below the first grate block, and is moved on this bearing surface with the corresponding advancing movement.

The incineration material that is conveyed over the grate blocks generally results in the latter being subject to a relatively high degree of abrasive wear. In the front region (also called the nose) of each grate block, the incineration material each case discharged from the bearing surface over a corresponding discharge edge onto the bearing surface of the succeeding grate block. The degree of abrasion, or attrition, is therefore particularly high in this front end region of the bearing surface, also called the advance section.

Due to the high temperatures during incineration, or in the combustion chamber, the grate blocks are also exposed to a very high thermal load. During normal operation of the incineration grate, this thermal load is high, in particular, in the region of the bearing surface, although the incineration material lying on the grate block has an insulating effect to a certain extent. However, load peaks occur especially when the incineration material is unevenly distributed on the incineration grate and forms only a thin insulating layer in places, or when this insulating layer is completely absent. The thermal load increases erosion caused by abrasion and chemical reactions occurring on the bearing surface, which further damage the bearing surface. These processes ultimately result in shortening of the service live of grate block.

In order to reduce the thermal load, the grate blocks are normally cooled with a coolant from below, i.e. on the side of the incineration grate opposite to the combustion.

Usually, air or water is used as a coolant. As mentioned above, however, the thermal load can also be reduced by even distribution the incineration material on the grate.

In order to crush and/or agitate the waste to a greater or lesser extent during transport from one grate block to the next grate block (underneath), grate blocks having special nose shapes have been proposed in the prior art.

The German patent application No. 568 164 discloses a moving grate that has movable and fixed grate elements (movable plungers and fixed plates). The fixed grate elements have a bead at the front end, the inner edge of the bead being designed to be rather flat or rather steep, depending on the composition of the waste to be incinerated. A rather flat inner edge is selected to increase the conveyance of the waste more, while a steep inner edge is selected to increase the agitation of the waste.

A disadvantage of this grate design is that it is unsuitable for widely varying waste compositions, as the slope of the inner edge of the bead cannot be modified during operation. Moreover, two different types of grate body are used (plungers and plates), which makes the structure of the grate and the replacement of the grate bodies more complex.

The German patent specifications Nos. 1 301 421 and 969 643 disclose grate bars that are provided with sharp-edged, pyramid-shaped projections in the respective advance section. These projections are used to crush the incineration waste by means of agitating movements.

Further, a grate block having pyramid-shaped projections in the nose region is disclosed in US 2013/0167762 A1. Specifically disclosed is a grate bar having a replaceable head, which is provided with a transport nose. The latter has a triangular cross-section and is mounted on an inclined surface of the replaceable head. In addition, the replaceable head comprises an agitation nose mounted on a horizontal surface of the head and likewise having a pyramid shape. The transport nose assists in the backward movement and circulation of the waste on the grate, while the agitation nose assists in the forward and downward movement of the waste on the grate.

The grate blocks known hitherto in moving grates have the disadvantage that the waste to be treated falls onto the grate block underneath with each advance, or in batches, with the usual advancing movements. The transfer of the waste from a first to a second grate block underneath it can be effected in two ways: On the one hand, the first grate block executes an advancing movement in the direction of conveyance and thus pushes the waste onto the second grate block arranged below the first grate block. On the other hand, the waste can also fall onto the second grate block arranged below it as a result of retraction of the first grate block. During the retraction movement of the grate block (against the direction of transport, or conveyance), the waste lying on it is only set in motion with a delay due to its inertia. Since the waste lies as a layer on the grate block, its backward movement is additionally hindered, with the result that the grate block executes a greater backward movement than the waste layer lying on it. Consequently, with each retraction movement of the grate block, the foremost part of the waste layer, as viewed in the direction of transport, fails onto the grate block arranged below.

As described above, the waste layer has an insulating effect and protects the grate block from excessive thermal load. In this respect, an even distribution of the waste is desirable. However, the "falling down" of the waste with each advance, or in batches, as described above often results in a waste layer of uneven thickness on the "receiving" grate block, contributing to the development of temperature peaks. Furthermore, the "falling down" of the waste creates air holes in the waste layer formed on the lower grate block, which likewise results in a localized intensification of flame formation and an associated increased thermal load on the grate block.

Although grate blocks having pyramid-shaped projections, such as those described, for instance, in DE 1 301 421 and DE 969 643, do cause the waste to move along concomitantly when the grate block is moved, the waste nevertheless continues to be delivered to the underlying grate block with each advance, or in batches, which correspondingly results in an irregular distribution, or thickness, of the waste layer.

Due to the different position of the grate blocks in the grate, they also differ in their attrition. It is generally the case that, the greater the thermal load, the greater is the abrasion of the bearing surface. Measured in longitudinal section, the abrasion of a grate block after one year is on average 5 mm. In a zone with high thermal load, the abrasion can be up to 10 mm after one year, which corresponds to a service life of 2-3 years for the grate block.

It is therefore the object of the invention to eliminate the disadvantages of the prior art and to provide an incineration grate that allows the incineration material, conveyed over the grate blocks, to be evenly distributed on the bearing surface of le grate blocks in order to avoid temperature peaks and the associated thermal load peaks.

The object is achieved according to the invention with a grate block according to claim 1 and an incineration grate according to claim 10. Preferred embodiments of the invention are given in the dependent claims.

The grate block according to the invention is part of an incineration grate that is composed of a plurality of such grate blocks and in which the grate blocks are arranged one above the other in a staircase-like manner. The incineration grate is intended for use in a plant for the thermal treatment of waste, in which the grate blocks are designed in such a manner that, by means of advancing movements executed relative to one another, during incineration the incineration material is rearranged and conveyed in a direction of conveyance.

The grate block according to the invention comprises a block body, realized as a casting, having a rear end and a front end that is opposite to the rear end in the direction of conveyance. The block body further comprises an upper wall, which forms an outer, rear bearing surface for the waste to be treated, and which is at least partially parallel to a longitudinal axis L of the block body. The rear bearing surface defines a substantially horizontal plane.

Furthermore, the grate block according to the invention comprises a nose, which is arranged in the region of the front end and is raised with respect to the horizontal plane. The raised nose in this case comprises a front bearing surface rising in the direction of conveyance up to a culmination point, as well as a downwardly sloping end portion that adjoins the front bearing surface after the culmination point. The downwardly sloping end portion comprises a discharge surface that slopes downward substantially in an arcuate manner in the direction of conveyance.

For the purposes of the present invention, grate blocks one above the other in a staircase-like manner are defined as grate blocks on a grate that are arranged like the steps of an ascending or descending staircase.

The term "advancing movements that can he executed relative to one other" is understood to mean advancing movements that are executed in, or counter to, the direction of conveyance of the material to be incinerated. In the case of a staircase grate, the direction of conveyance of the material to be incinerated thus runs parallel to the inclination, or gradient, of the grate.

The "longitudinal axis of the block body, or of the grate block" in this case denotes an axis that is parallel to the overall inclination of the staircase grate, and thus parallel to the direction of conveyance of the waste to be treated.

For the purposes of the present application, the term "bearing surface" is understood to mean a surface which is arranged on the outer upper side of the grate block and on which the waste intended for thermal treatment rests. As mentioned at the beginning, this bearing surface in incineration plants is known to be subject to elevated mechanical and thermal loads and is susceptible to caking of combustion products.

"Nose" refers in general to the foremost part of the block body in the direction of conveyance. For the purposes of the present application, a "raised nose" is understood to be a nose of which the highest point is above the rear bearing surface in the vertical direction.

A "culmination point" is defined in general as a highest point and, in this application, the highest point of the raised nose. The culmination point in this case may be realized as a singular point, for example as the vertex of a pyramid or as the uppermost point of a curve or an arc. However, the culmination point may also be realized as a horizontal plane. In this case, the entire plane would be defined as a culmination point in the sense of a culmination plane.

"Downwardly sloping end portion" denotes a surface that is located at the front end of the block body in the direction of conveyance and that slopes downwardly from the culmination point. According to the invention, the downwardly sloping end portion slopes downward in a vertical direction. This means that the downwardly sloping end portion has a negative gradient.

The term "substantially in an arcuate manner" is used to define that the downwardly sloping discharge surface is realized in the shape of an arc or preferably in the shape of a circular arc. Such an arcuate surface may also be formed by a serial arrangement of a multiplicity of short, straight surface segments, which, however, as a whole form the shape of an arc.

Compared to the prior art, the grate block according to the invention has the advantage that, because of the raised nose, the waste is discharged successively and evenly, as it were fluidly, from a first grate block to a second grate block below it, and thus discharge of the waste with each advance, or in batches, is counteracted. The raised nose in this case acts as an obstacle that prevents the waste from falling down in batches during retraction. Similarly, waste that has been delivered from the first to the second grate block is conveyed from the second to the third grate block during the advancing movement of the first grate block. This controlled advancing movement prevents the waste from "falling down" in batches and enables the waste to be conveyed in a continuous flowing movement, which ultimately results in the formation of a more even waste layer on the bearing surface of the grate blocks. This even waste layer has a uniform insulating effect and thus prevents thermal load peaks on the grate block.

In a preferred embodiment of the grate block, the culmination point is spaced in the vertical direction at a distance of 10-35 mm, preferably 15-30 mm, and particularly preferably 18-25 mm, and most particularly preferably 20-21 mm, from the horizontal plane.

It has been shown that a grate block having the above-mentioned values for the distance in the horizontal plane (also referred to as clear width or clear distance) is particularly suitable for producing an even waste layer on the grate block underneath.

Preferably, the rising front bearing surface is realized. in the form of a ramp, and in a middle portion has an average positive gradient of 10-35%, preferably 15-32%, and particularly preferably 20-30%, and most particularly preferably 26-28%.

For the purposes of the present invention, a "ramp" or "in the form of a ramp" denotes a surface that adjoins the horizontal plane and has a positive gradient, i.e. results in a point that is higher than the horizontal plane. The ramp in this case may be of any shape (e.g. convex or S-shaped).

It has been shown that a bearing surface in the form of a ramp, having an average gradient according to the above-mentioned values, is particularly suitable for producing an even layer of waste on the grate block underneath.

In a preferred embodiment of the grate block, the front bearing surface is S-shaped as viewed in longitudinal section along the direction of conveyance.

For the purposes of the present invention, an "S-shaped" front bearing surface (as viewed in longitudinal section) is understood to mean that the bearing surface has a steadily increasing positive gradient in a first region that adjoins the horizontal plane, and a steadily decreasing positive gradient in a second region that directly or indirectly adjoins the first region in the direction of conveyance. Preferably, in a third region, arranged between the first and second region, the positive gradient may be constant. Other terms for an "S-shaped" curve are sigmoid function, gooseneck function or Fermi function. An equation for an example of an S-shaped curve is:

$$\mathrm{sig}(t)=0.5*(1+\tanh(t/2)) \quad (1)$$

It has been shown that a grate block having a front bearing surface that is S-shaped as viewed in longitudinal section allows a very even transfer of the waste to be incinerated and thereby produces an even layer of waste on the grate blocks underneath.

Preferably, the discharge surface that slopes downward in an arcuate manner comprises a preferably rounded discharge edge at a point that is foremost in the direction of conveyance.

The rounded discharge edge has the advantage of reducing attrition of material in this region of the nose. It also allows for a smooth transfer of waste to the adjoining grate block below, forming an even layer of waste and preventing a localized cutting-torch effect.

In a preferred embodiment of the grate block, the downwardly sloping end portion comprises a first arcuate segment in the region between the culmination point and a point that is foremost in the direction of conveyance.

The said first arcuate segment may be part of the arcuate discharge surface or form a connection portion between the culmination point and the arcuate discharge surface. The arcuate contour of the first arcuate segment allows an even flow of waste to be incinerated on the front bearing surface, reducing friction and thus attrition on the grate block and creating an even layer of waste on the grate blocks underneath.

Preferably, the first arcuate segment has a first radius of curvature R1 of a length of 60-120 mm, preferably of 70-110 mm, particularly preferably of 80-100 mm, and most particularly preferably of 90 mm.

The average radius of the first arcuate segment is defined as the "first radius of curvature R1". It is quite conceivable for the first arcuate segment to be composed of smaller straight sub-sections that as a whole form an arcuate segment. Preferably, the outer surface of the arcuate segment, as viewed in longitudinal section, forms the arc line of a circular sector. As viewed in longitudinal section, the surface of the first arcuate segment is thus delimited by the circular arc and two circle radii. With regard to uniform conveyance of the waste over the first arcuate segment, a radius of curvature having the previously defined values has proven to be particular advantageous.

In a preferred embodiment of the grate block, the first arcuate segment spans in longitudinal section a sector surface that has a center angle a of between 60° and 72°, preferably of about 66°.

Preferably, the downwardly sloping end portion comprises a second arcuate segment that particularly preferably adjoins the first arcuate segment in the direction of conveyance, and most particularly preferably directly adjoins the first arcuate segment.

The first and the second arcuate segment may be directly connected to each other or via a middle piece. The middle piece can be realized as a straight surface, or also as an arcuate segment.

In a preferred embodiment of the grate block, the second arcuate segment, as viewed in longitudinal section, has a second radius of curvature R2, preferably having a length of 10-30 mm, preferably of 15-25 mm, particularly preferably of 18-22 mm, and most particularly preferably of 20 mm.

The average radius of the second arcuate segment (as viewed in longitudinal section) is defined as the "second radius of curvature R2". It is quite conceivable for the second arcuate segment to be composed of smaller straight sub-sections that as a whole form an arcuate segment.

Preferably, the first and second radius of curvature are of different lengths. This also means that the first arcuate segment and the second arcuate segment preferably have a different arc curvature. Different arc curvatures, in particular with the above-mentioned preferred radii of curvature R1 and R2, have been shown to be particularly effective in respect of successive refuse discharge over the discharge edge.

Preferably, the second arcuate segment, as viewed in longitudinal section, defines a sector surface having a center angle of between 70° and 120°, preferably of about 90°.

In a preferred embodiment of the grate block, the block body has a front wall that is set back from the foremost point (as viewed in the direction of conveyance) of the downwardly sloping end portion in the direction opposite to the direction of conveyance, such that an undercut is formed. In this preferred embodiment, the grate block thus has a projecting nose. Particularly preferably, the grate block comprises air openings the front wall in the region of the undercut. This has the advantage that ventilation openings for delivering primary or secondary air can be arranged beneath the discharge edge and are thus not blocked or clogged by the falling waste. The preferably arcuate transition from the discharge edge to the undercut is advantageous with regard to a uniform waste discharge movement.

In a preferred embodiment, the distance between the culmination point (23) and the discharge edge, measured in longitudinal section, is 60-100 mm, preferably 70-90 mm and particularly preferably 80-82 mm.

Preferably, the nose has a length of 170 mm, measured along the longitudinal axis. The length of the nose is defined in this case as the clear distance between the starting point of the rising ramp-type front bearing surface and the discharge edge.

The above preferred dimensions in respect of the distance between the culmination point and the discharge edge, as well as the length of nose, are advantageous, in particular, with regard to the use of the grate block in a refuse incineration plant.

In a preferred embodiment, the grate block has a depression in the rear bearing surface, preferably adjacent to the front bearing surface. Preferably, there are ventilation openings arranged in the region of this depression. The said ventilation openings preferably define the outlet of an air channel, which leads through an elevation that has a volcano-like outer contour. The air channel preferably widens continuously from the ventilation opening toward the inside of the block body. In this way, clogging of the air supply openings by waste particles is counteracted in an effective manner.

The invention further relates to a grate comprising a plurality of grate blocks according to the invention.

Preferably, the individual grate blocks move in the grate at a speed of 0-5 mm/s over an advance distance of 150-250 mm, particularly preferably approximately 200 mm. In comparable known plants, advance distances of up to 350-450 mm are common. Due to the preferably comparatively rather short advance distances according to the invention, the grate blocks are moved up to 45 times per hour over from a starting position to an end position and back to the starting position. Shorter advance distances have proven to be advantageous with regard to a uniform transfer of the incineration material.

In a main incineration zone of the grate, the grate blocks preferably move at 2-3 mm/s, and in the afterburning zone of the grate preferably at 1 mm/s. The speed of the individual block bodies is usually adjusted based on the composition of the waste to be incinerated.

The invention is explained in greater detail in the following on the basis of some exemplary embodiments represented in the figures. If alternative embodiments differ only in individual features, the same reference signs have been used in each case for the features that remain the same. In the figures, which are each merely schematic:

Figure 1:
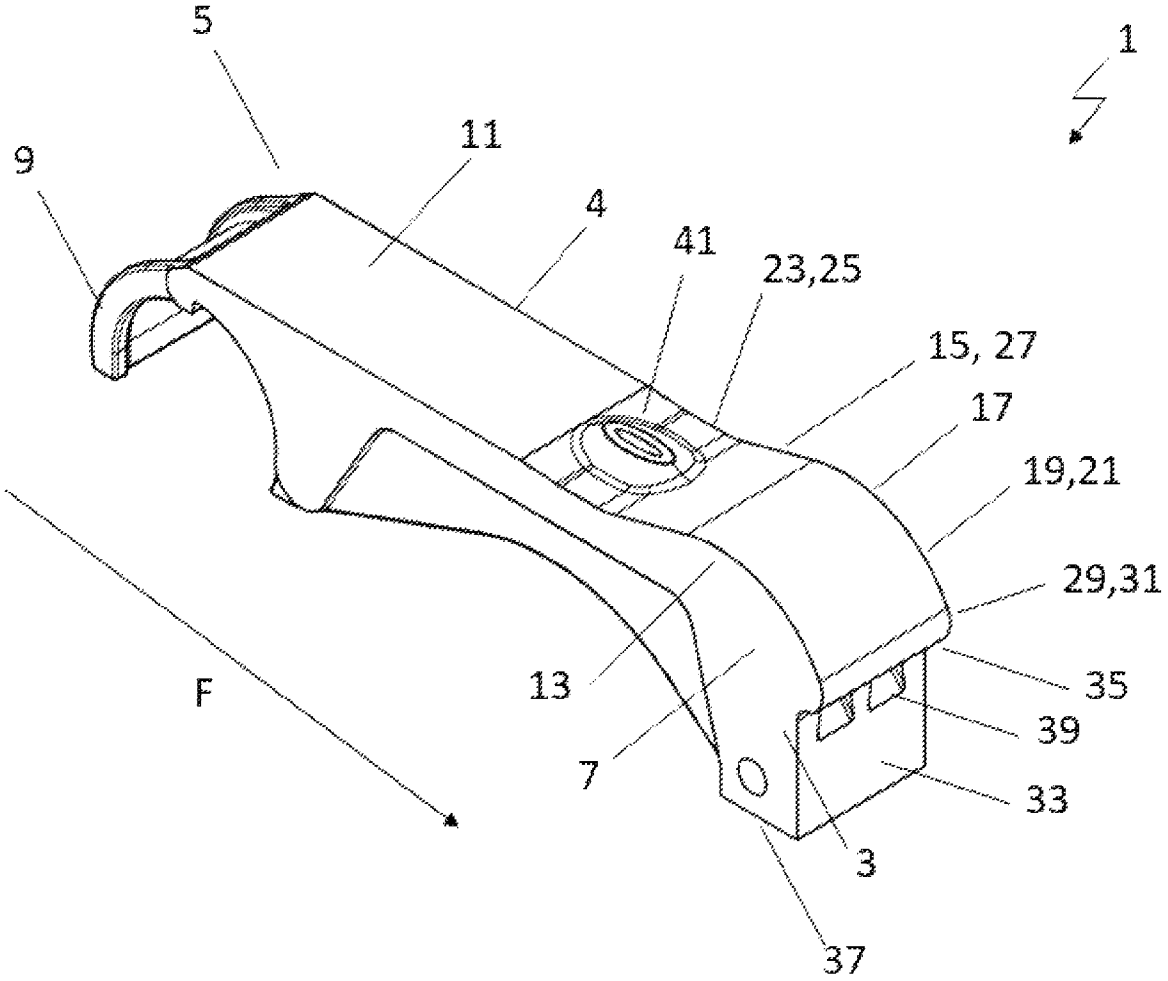
FIG. 1 shows a perspective view of an embodiment of a grate block according to the invention.
Figure 2:
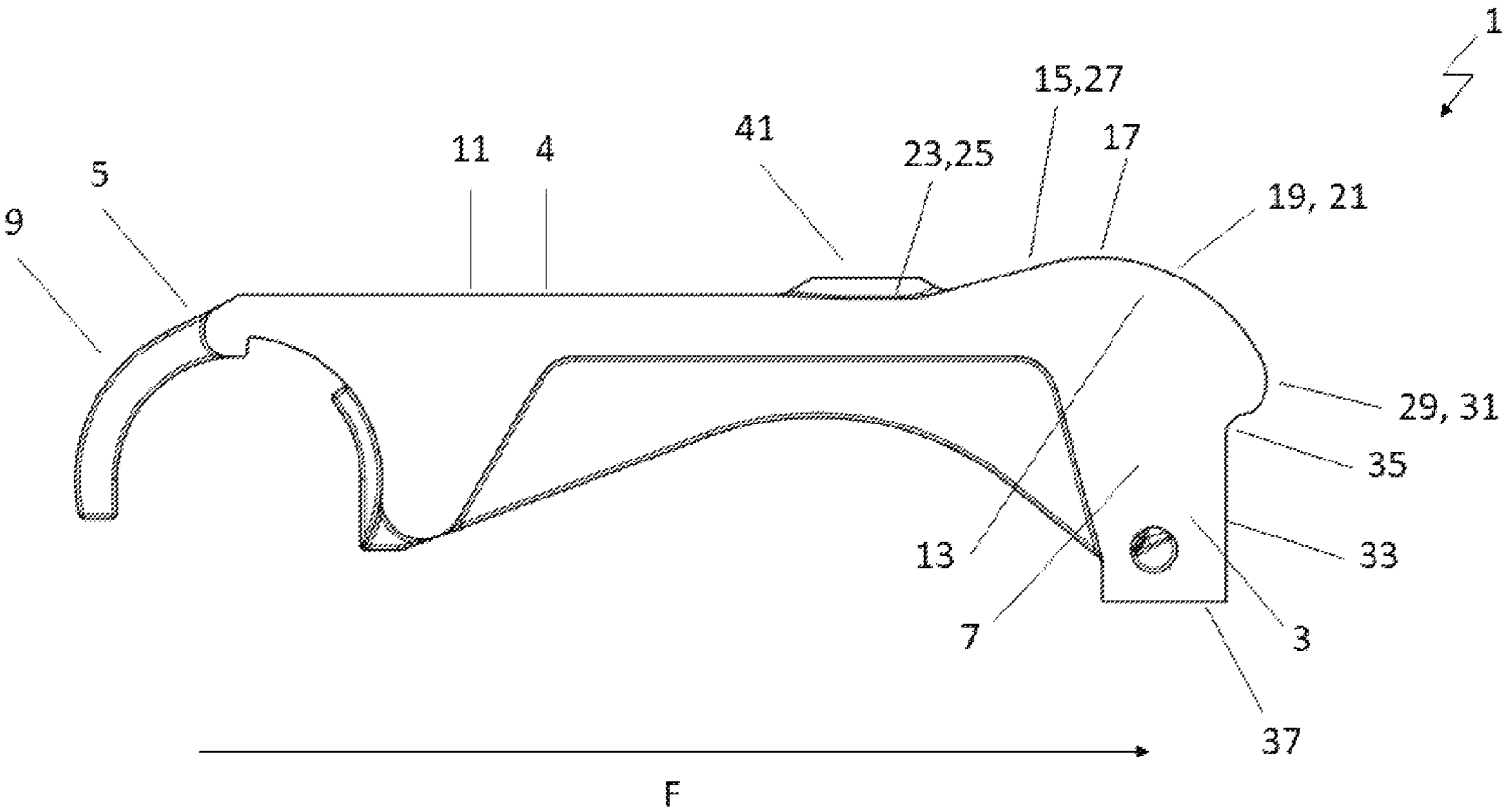
FIG. 2 shows a longitudinal section, along the longitudinal axis L, through the block body from FIG. 1.

The grate block 1 depicted in FIGS. 1 and 2 comprises a block body 3, realized as a casting, having an upper wall 4 that extends in the direction of conveyance F from a rear end 5 to a front end 7. In the region of the rear end 7, the block body comprises a fastening device 9, by means or which the block body 3 is coupled to a drive system (not represented) in the grate and which initiates its movements in or counter to the direction of conveyance F. Further, in the region of the rear end 5, the block body 3 comprises an outer, rear bearing surface 11 for thermal treatment of the waste to be incinerated. In the region of the front end 7, the block body 3 comprises a raised nose 13. The latter, as viewed in the direction of conveyance F, comprises an outer front bearing surface 15 that rises to a culmination point 17, and a downwardly sloping end portion 19 adjoining the culmination point 17 and having discharge surface 21 that slopes downward substantially in an arcuate manner. The rear bearing surface 11 defines a substantially horizontal plane 23 that has a depression 25. Adjoining the horizontal plane 23 in the direction of conveyance F is the outer, front bearing surface 15. The rising, outer front bearing surface 15 is in the form of a ramp and substantially S-shaped as viewed in longitudinal section. In the embodiment shown, the gradient of the front bearing surface 15 increases steadily from the horizontal plane 23 until it remains constant in a middle portion 27, and then decreases toward the culmination point such that the gradient approaches zero in the direction of the culmination point 17. The culmination point 17 is realized here as a singular point between the front bearing surface 15 and the downwardly sloping end portion 19, but could alternatively also be realized as a "culmination plane". The downwardly sloping end portion 19 of the raised nose 13 comprises a rounded discharge edge 31 at a point 29 that is foremost as viewed in the direction of conveyance F.

The block body 3 further comprises a front wall 33, set back from the foremost point 29 of the downwardly sloping end portion 19 in the direction opposite to the direction of conveyance F, that forms an undercut 35 with the downwardly sloping end portion 19. Adjoining the front wall 33 of the block body 33 at the bottom is a sliding surface 37, by means of which the block body 3 slides on the outer rear be surface 11 of a second grate block located underneath (not represented). The front wall 33 comprises ventilation openings 39, which are protected from falling waste by their position in the region of the undercut 35, such that clogging of the ventilation openings 39 can be counteracted. The upper wall 4 also comprises, in the region of the horizontal plane 23, a further ventilation opening 41, which constitutes the outlet of an air channel through a pyramid-shaped or volcano-shaped elevation. The diameter of the air channel widens concentrically from the ventilation opening 41 toward the interior of the block body, so that waste entering the air channel through the ventilation opening 41 falls through downwardly due to the widening diameter, without clogging the ventilation opening 41. The ventilation openings 39 and 41 serve to deliver primary or secondary air in order to enable efficient incineration.

Figure 3:
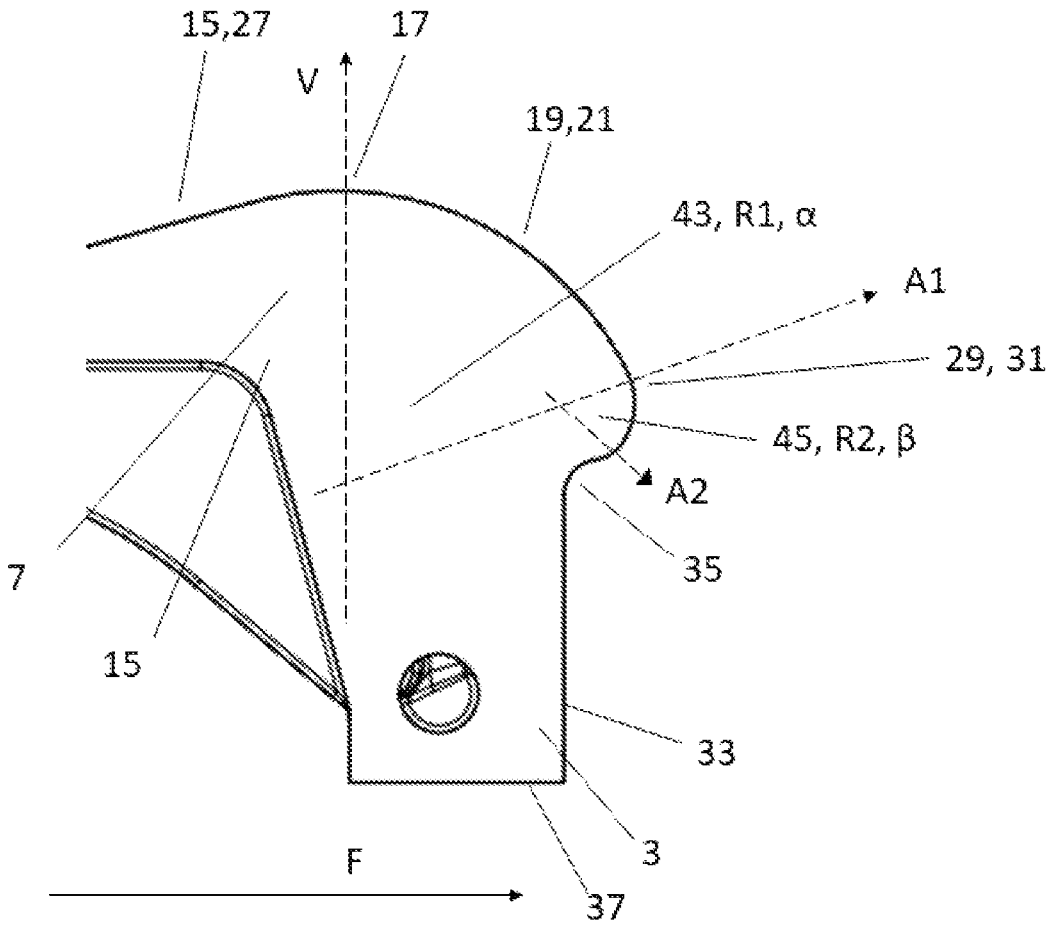
FIG. 3 shows an enlarged view of a longitudinal section, along the longitudinal axis L, through a front region of the block body from FIG. 1.

FIG. 3 shows an enlarged view of the raised nose 13 and of the front region 7 of the grate block from FIG. 1. A vertical axis V, represented by dashed lines, runs through the culmination point 17. Starting from the culmination point 17, the outer contour of the downwardly sloping end portion 19 slopes downward in the direction of conveyance F, forming a first arcuate segment 43. The first arcuate segment 43 has an average radius of curvature R1, and spans an angle $\propto$ between the vertical axis V and a first segment axis A1. Adjoining the first arcuate segment 43 is a second arcuate segment 45. The second arcuate segment 45 has an average radius of curvature R2, and spans an angle $\beta$ between the first segment axis A1 and a second segment axis A2. The first and the second arcuate segment 43, 45 may be connected to each other directly or via a middle piece (not represented). The middle piece in this case may be realized as a straight surface or also as an arcuate segment. Depending on the magnitude of the angles $\propto$ and $\beta$, the foremost point 29 with the rounded discharge edge 31 may be positioned in the first or second arcuate segment 43, 45.

The invention claimed is:

1. A grate block, as part of an incineration grate for thermal treatment of waste, in which the grate blocks are arranged one above the other in a staircase-like manner and are designed in such a manner that, by means of advancing movements executed relative to one another, during incineration the incineration material is rearranged and conveyed in a direction of conveyance F, wherein the grate block comprises a block body, realized as a casting, having the following components:

a rear end and a front end that is opposite to the rear end in the direction of conveyance F, an upper wall, which is substantially parallel to a longitudinal axis L of the block body and forms a rear bearing surface for the waste to be treated, wherein the rear bearing surface defines a substantially horizontal plane, and a nose, which is arranged in the region of the front end and is raised with respect to the horizontal plane, wherein the raised nose comprises a front bearing surface rising in the direction of conveyance F up to a culmination point, as well as a downwardly sloping end portion that adjoins the front bearing surface after the culmination point, wherein the downwardly sloping end portion comprises a discharge surface that slopes downward substantially in an arcuate manner in the direction of conveyance F, and wherein the front bearing surface is S-shaped as viewed in longitudinal section along the direction of conveyance F.

2. The grate block as claimed in claim 1, wherein the culmination point is spaced in the vertical direction at a distance of 10-35 mm from the horizontal plane.

3. The grate block as claimed in claim 1, wherein the rising front bearing surface is realized in the form of a ramp, and in a middle portion has an average gradient of 10-35%.

4. The grate block as claimed in claim 1, wherein the discharge surface that slopes downward in an arcuate manner comprises a rounded discharge edge at a point that is foremost in the direction of conveyance F.

5. The grate block as claimed in claim 1, wherein the downwardly sloping end portion comprises a first arcuate segment in the region between the culmination point and a point that is foremost in the direction of conveyance F.

6. The grate block as claimed in claim 5, wherein the first arcuate segment has a first radius of curvature R1 of a length of 60-120 mm.

7. The grate block as claimed in claim 5, wherein the first arcuate segment spans in longitudinal section a sector surface that has a center angle a of between 60° and 72°.

8. The grate block as claimed in claim 5, wherein the downwardly sloping end portion comprises a second arcuate segment that adjoins the first arcuate segment in the direction of conveyance F.

9. The grate block as claimed in claim 8, wherein the second arcuate segment has a second radius of curvature R2.

10. The grate block as claimed in claim 9, wherein the second arcuate segment, as viewed in longitudinal section, defines a sector surface having a center angle β of between 70° and 120°.

11. The grate block as claimed in claim 4, wherein the block body has a front wall that is set back from the foremost point of the downwardly sloping end portion in the direction opposite to the direction of conveyance F, such that an undercut is formed.

12. The grate block as claimed in claim 11, wherein there are ventilation openings in the region of the front wall of the undercut.

13. The grate block as claimed in claim 1, wherein there is a depression realized in the rear bearing surface.

14. A grate comprising a plurality of grate blocks according to claim 1.

* * * * *